United States Patent [19]

Wilkinson

[11] 4,196,485

[45] Apr. 8, 1980

[54] JOINT AND METHOD OF JOINING

[76] Inventor: Horace A. Wilkinson, 13 Korocan Rd., Lilli Pilli, 2229, N.S.W., Australia

[21] Appl. No.: 881,963

[22] Filed: Feb. 27, 1978

Related U.S. Application Data

[63] Continuation-in-part of Ser. No. 705,208, Jul. 14, 1976, Pat. No. 4,085,525.

[30] Foreign Application Priority Data

Sep. 1, 1977 [AU] Australia ..... PD 1462

[51] Int. Cl.[2] ..... A42D 25/00; A43D 21/00; B25G 3/34

[52] U.S. Cl. ..... 12/147 R; 36/34 R; 403/268

[58] Field of Search ..... 12/147 R, 147 A; 403/268, 269; 36/34 R

[56] References Cited

U.S. PATENT DOCUMENTS

| | | | |
|---|---|---|---|
| 3,054,713 | 9/1962 | Walter | 12/147 R |
| 3,298,144 | 1/1967 | Fischer | 403/268 |
| 4,041,599 | 8/1977 | Smith | 403/268 |
| 4,050,727 | 9/1977 | Bonnes | 403/268 |

FOREIGN PATENT DOCUMENTS

| | | | |
|---|---|---|---|
| 982636 | 6/1951 | France | 12/147 R |

*Primary Examiner*—Patrick D. Lawson

*Attorney, Agent, or Firm*—Beveridge, DeGrandi, Kline & Lunsford

[57] ABSTRACT

A method of rigidly fixing an end portion of an elongated column member within a cavity in a body member. A quantity of hardenable adhesive material is placed into the cavity such that when the column member end portion is inserted into the cavity, the resulting displacement of a portion of the adhesive material causes the adhesive material substantially exactly to fill the cavity. The column member end portion is then inserted into the cavity, and the adhesive material is allowed to harden. The angular position of the column member relative to the body member can be adjusted as desired prior to hardening of the adhesive material. Preferably, the method is automated, including injecting a measured amount of adhesive material into the cavity and holding the column member and the body member in a jig while the adhesive material hardens. The adhesive material can be an epoxy resin, and if desired, the hardening can be accomplished by heat curing. The body member might be formed of nylon, and the column member might be formed of steel. The method is particularly suited for forming shoe supports such as shoe heel structures, each including an upper support member, a lower support member, and a plurality of elongated column members. Two or more column members may be fastened within a single cavity, if desired.

30 Claims, 4 Drawing Figures

JOINT AND METHOD OF JOINING

CROSS REFERENCE TO RELATED APPLICATIONS

This application is a continuation-in-part of United States patent application Ser. No. 705,208, filed July 14, 1976, now U.S. Pat. No. 4,085,525.

BACKGROUND OF THE INVENTION

The present invention relates to a method of joining pins, rods, or column members to body members. More particularly, the present invention pertains to a method of joining pins, rods or column members to body members by affixing the ends of such column members in cavities formed in the body members. The method of the present invention is particularly well suited for constructing shoe supports of the type generally described in applicant's parent U.S. Pat. No. 4,085,525.

In the specification of U.S. Pat. No. 4,085,525, there is described a shoe support, such as a heel, which consists of a plurality of straight column members having their upper ends, either directly or through another upper support member, fixed to the shoe and their lower ends fixed to a lower, ground-contacting support member. In one of the embodiments described in that patent application, the column members are fixed to the shoe structure or to the lower support member, or to both, by means of a hardenable adhesive material such as an epoxy resin, the ends of the several column members being positioned in respective cavities which are filled with the adhesive material.

The present invention pertains to an improved method for fixing the ends of column members in support members and is particularly well suited for the making of shoe supports of the type shown in U.S. Pat. No. 4,085,525.

In a broad form of the invention as presently contemplated, the pin or column member is provided with an enlarged head and is fixed in a cavity by first placing into the cavity a quantity of hardenable adhesive material such that when the column member end portion is inserted into the cavity, the resulting displacement of a portion of the adhesive material causes the adhesive material substantially exactly to fill the cavity, inserting the column member end portion into the cavity, and allowing the adhesive material to harden. Two or more column members may be fixed within a single cavity if desired.

BRIEF DESCRIPTION OF THE DRAWINGS

These and other aspects and advantages of the present invention are more apparent in the following detailed description and claims, particularly when considered in conjunction with the accompanying drawings in which like parts bear like reference numerals. In the drawings:

DESCRIPTION OF A PREFERRED EMBODIMENT

Figure 1:
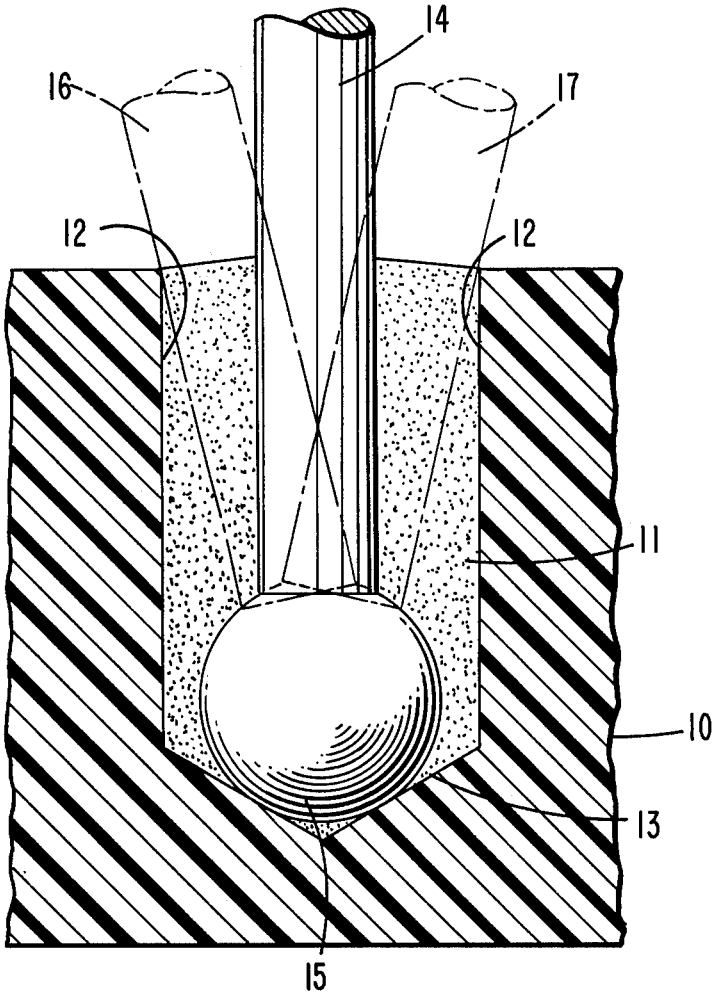
FIG. 1 is an enlarged, fragmentary cross-sectional view depicting the end portion of a column member fixed within a cavity in a body member in accordance with the present invention and is taken generally along line 1—1 of FIG. 2.

Body member 10, depicted in FIG. 1, can be formed, for example, by injection molding of a suitable material such as nylon, and is provided with a cavity 11 having substantially parallel side walls 12 and a substantially conical bottom wall 13. Preferably body member 10 is molded with cavity 11 formed therein, but if desired, the cavity can be formed into molded body member blanks.

Elongated column member 14, which, by way of example, can be formed of a high strength steel, is depicted in this embodiment as having a substantially circular cross-section. Column member 14 is provided with an enlarged head 15 which can be of a substantially spherical configuration. In a typical application, column member 14 may be of a diameter in the order of about 2 to 2.5 mm, with spherical head 15 having a diameter in the order of about 4 mm. Cavity 11 is somewhat larger in cross-section than head 15, for example being about one mm larger in diameter. As a consequence, before the adhesive material in cavity 11 has hardened, the position of column member 14 can be adjusted angularly with respect to body member 10. Shown in ghost outlines at 16 and 17 are extreme possible angular positions of the shank of the column member 14, thus illustrating the flexibility achievable by this method of fixing. Naturally, the greater the diameter of cavity 11, the greater the possible angularity of column member 14 in relation to the body member 10.

In the preferred practice of the present invention, prior to the insertion of head 15 into cavity 11, a quantity of hardenable adhesive material such as an epoxy resin adhesive is injected into the cavity. This quantity is precisely dispensed so that when head 15 is inserted into cavity 11 to the desired extent, e.g. until head 15 contacts bottom wall 13 as depicted in FIG. 1, with resulting displacement of a portion of the adhesive material by the head 15 and the adjacent end portion of the shank of the pin 14, cavity 11 is substantially exactly filled with the adhesive material. The quantity of adhesive material required can be readily determined from the geometries of the head portion 15, the adjacent end portion of column member 14, and cavity 11. This filling technique lends itself well to automatic operation and avoids any human contact with the hardenable adhesive material during the assembly of the shoe or other product. Head 15 and the adjacent end portion of column member 14 are then inserted to the desired extent into cavity 11 to displace a portion of the adhesive material. The angular position of column member 14 relative to body member 10 can be adjusted as desired prior to hardening of the adhesive material. The adhesive material is then allowed to harden. The joining operation can be performed with the aid of jigs which are pre-set to ensure the exact desired relationship between the members being joined. For example, when the present method is utilized in the assembly of shoes of the type shown in U.S. Pat. No. 4,085,525, the use of jigs to hold the various members ensures that the desired positional relationship is achieved between the heel plates and the foot of the heel, and the sole of the shoe. The jigs can be fitted to a curing machine to assure that the desired positions are maintained when the adhesive has hardened. The assembled unit is cured for a time suited for the adhesive material utilized for example a time in order of about one hour. This curing can be aided by heat, if appropriate, depending upon the particular adhesive material used. The jig is then available for another assembly operation or for the packing of the finished product.

It will be appreciated that since the end portion of column member 14 is plunged into the partially filled cavity 11, complete contact between the end portion of the column member and the adhesive material is achieved without cavitation, and it has been found that a joint of great strength is achieved in this manner. In order to destroy the joint, in fact, such force is required as to burst the material of the body member 10 or to break the column member 14.

Figure 2:
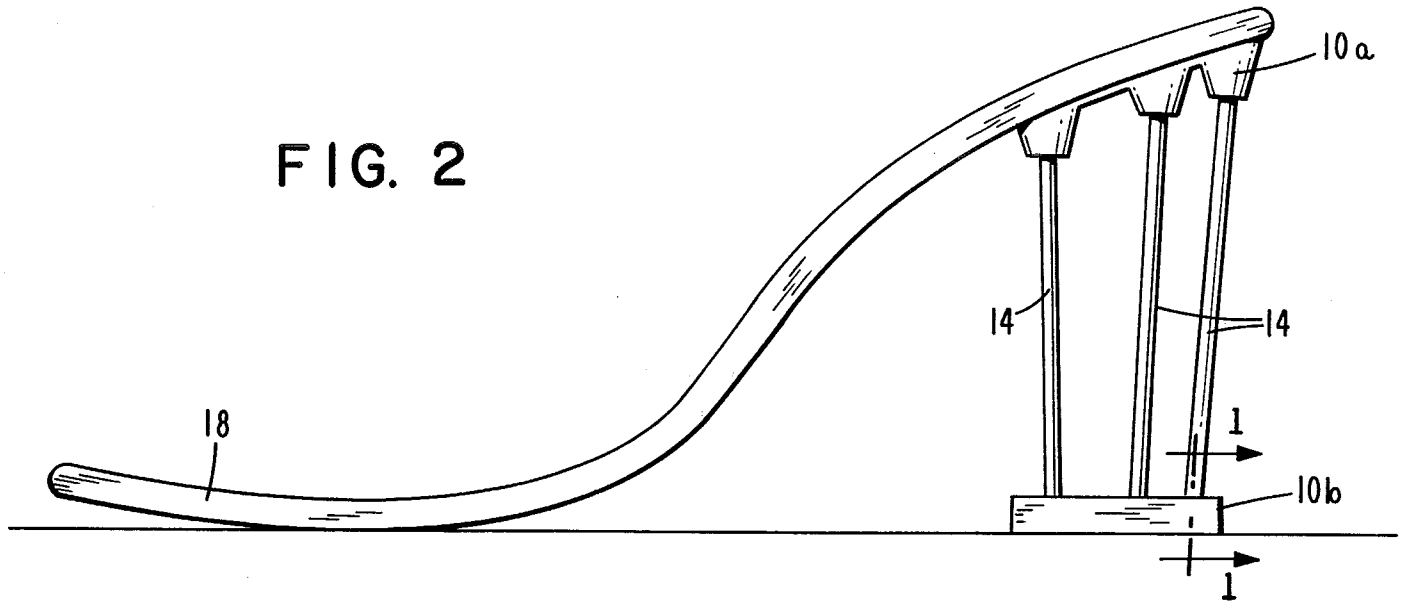
FIG. 2 is an elevational view of a shoe structure including a shoe support formed in accordance with the present invention.

FIG. 2 depicts a shoe structure 18 including a shoe support in the form of upper support member 10*a*, lower support member 10*b*, and column members 14. The end portions of the several column members 12 are rigidly fixed within respective cavities in upper support member 10*a* and lower support member 10*b* in accordance with the method of the present invention. The angular position of column members 14 relative to upper support member 10*a* can be adjusted to accommodate various heel heights.

With joints constructed in the manner described, and with the column members of the heel of a shoe such as depicted in FIG. 2 and disclosed in U.S. Pat. No. 4,085,525 forming a trapezoidal column structure, a heel structure is provided which combines great strength with sufficient flexibility to enable it to deal with lateral blows.

Figure 3:
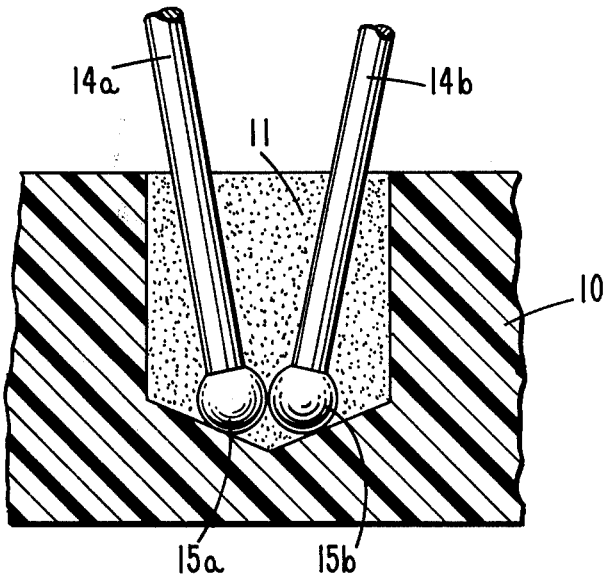
FIG. 3 is a fragmentary cross-sectional view similar to FIG. 1 but depicting a joint including a plurality of column members fixed within a single cavity.
Figure 4:
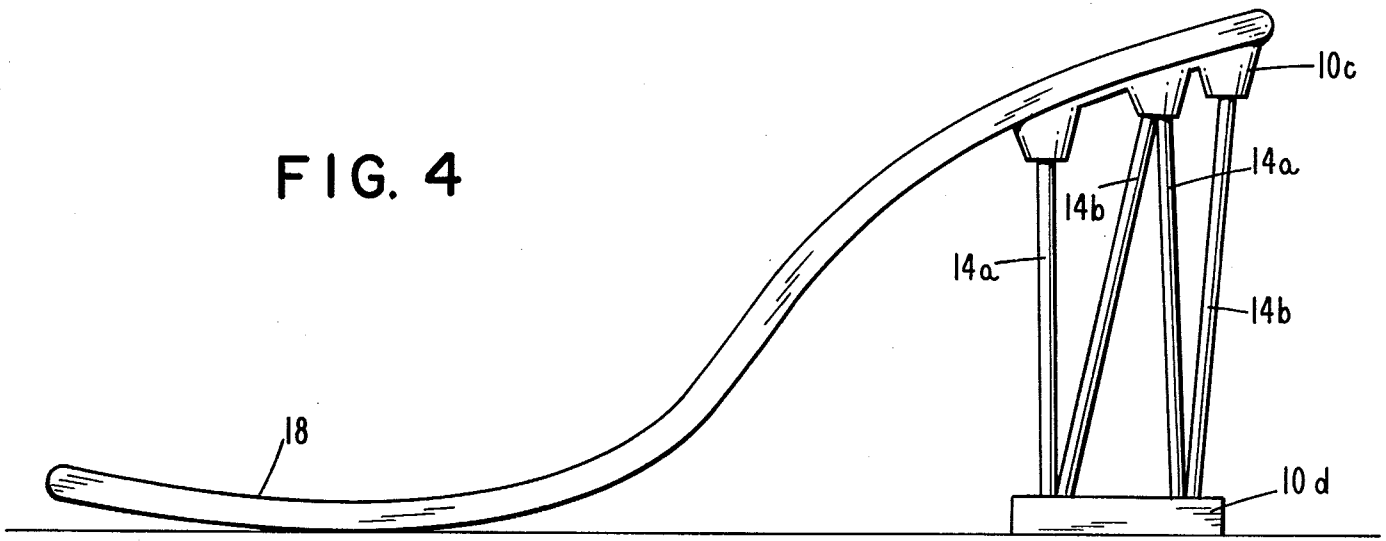
FIG. 4 is an elevational view similar to FIG. 2 but showing a shoe support including a joint of the type depicted in FIG. 3.

As depicted in FIG. 3, a plurality of column members, illustratively depicted in FIG. 3 as two column members 14*a* and 14*b*, can be fixed within a single cavity 11 of a body member 10 in accordance with the present invention. FIG. 4 illustrates a shoe structure 18*a* including a shoe support with joints having two column members 14*a* and 14*b* fixed within each cavity of upper support member 10*c* and lower support member 10*d*.

While the joint has been described above particularly in relation to the fixing of column members in the heel portion of a shoe, it will be appreciated that the same technique may be employed for the fixing of pins, rods, or column members in similar shoe supporting structures other than at the heel and in other diverse structures.

It will be appreciated that the invention is capable of embodiment in forms other than that specifically described above, and the present invention should not be regarded as restricted by the particularity of the preceding description.

What is claimed is:

1. A method of forming a shoe support including an upper support member having a plurality of first cavities therein, a lower support member having a like plurality of second cavities therein, and a like plurality of elongated column members each with a first end and a second end, said method comprising the steps of:

placing hardenable adhesive material into each of said first cavities in amounts such that when said column member first ends are inserted into respective ones of said first cavities to the desired extent, the resulting displacement of adhesive material causes the adhesive material substantially exactly to fill each said first cavity;

inserting said column member first ends into respective ones of said first cavities to the desired extent;

placing hardenable adhesive material into each of said second cavities in amounts such that when said column member second ends are inserted into respective ones of said second cavities to the desired extent, the resulting displacement of adhesive material causes the adhesive material substantially exactly to fill each second cavity;

inserting said column member second ends into respective ones of said second cavities to the desired extent; and allowing said adhesive material to harden.

2. A method as claimed in claim 1 further comprising the step of holding the column members and at least one of the upper support member and the lower support member within at least one jig while allowing said adhesive material to harden.

3. A method as claimed in claim 2 further comprising the step of adjusting the angular position of the column members relative to at least one of the upper support member and the lower support member prior to allowing the adhesive to harden.

4. A method as claimed in claim 1 further comprising the step of adjusting the angular position of the column members relative to at least one of the upper support member and the lower support member prior to allowing the adhesive to harden.

5. A method as claimed in claim 1 in which the hardenable adhesive material is placed into the cavities by injecting the adhesive material into the cavities.

6. A method as claimed in claim 1 in which the hardenable adhesive material is an epoxy resin.

7. A method as claimed in claim 6 in which the adhesive material is hardened by heat curing.

8. A method as claimed in claim 6 in which at least one of said upper support member and said lower support member is formed of nylon.

9. A method as claimed in claim 8 in which said column members are formed of steel.

10. A method as claimed in claim 6 in which said column members are formed of steel.

11. A method as claimed in claim 1 in which at least one of said upper support and said lower support is formed of nylon.

12. A method as claimed in claim 11 in which said column members are formed of steel.

13. A method as claimed in claim 1 in which said column members are formed of steel.

14. A method as claimed in claim 1 further comprising inserting the first end of a further column member into one of said first cavities prior to allowing the hardenable adhesive material to harden.

15. A method of joining a first body member having a plurality of first cavities therein, a second body member having a plurality of second cavities therein, and a plurality of elongated column members each with a first end and a second end, said method comprising the steps of:

placing hardenable adhesive material into each of said first cavities in amounts such that when said column member first ends are inserted into respective ones of said first cavities to the desired extent, the resulting displacement of adhesive material causes the adhesive material substantially exactly to fill each said first cavity;

inserting said column member first ends into respective ones of said first cavities to the desired extent;

placing hardenable adhesive material into each of said second cavities in amounts such that when said column member second ends are inserted into respective ones of said second cavities to the desired extent, the resulting displacement of adhesive material causes the adhesive material substantially exactly to fill each second cavity;

inserting said column member second ends into respective ones of said second cavities to the desired extent; and allowing said adhesive material to harden.

16. A method as claimed in claim 15 further comprising the step of holding the column members and at least one of the first body member and the second body member within at least one jig while allowing said adhesive material to harden.

17. A method as claimed in claim 16 further comprising the step of adjusting the angular position of the column members relative to at least one of the first body member and the second body member prior to allowing the adhesive to harden.

18. A method as claimed in claim 15 further comprising the step of adjusting the angular position of the column members relative to at least one of the first body member and the second body member prior to allowing the adhesive to harden.

19. A method as claimed in claim 15 in which the hardenable adhesive material is placed into the cavities by injecting the adhesive material into the cavities.

20. A method as claimed in claim 15 in which the hardenable adhesive material is an epoxy resin.

21. A method as claimed in claim 20 in which the adhesive material is hardened by heat curing.

22. A method as claimed in claim 20 in which at least one of said first body member and said second body member is formed of nylon.

23. A method as claimed in claim 22 in which said column members are formed of steel.

24. A method as claimed in claim 20 in which said column members are formed of steel.

25. A method as claimed in claim 15 in which at least one of said first body member and said second body member is formed of nylon.

26. A method as claimed in claim 25 in which said column members are formed of steel.

27. A method as claimed in claim 15 in which said column members are formed of steel.

28. A method as claimed in claim 15 further comprising inserting the first end of a further column member into one of said first cavities prior to allowing the hardenable adhesive material to harden.

29. A method as claimed in claim 15 in which the step of placing hardenable adhesive material includes:

determining the quantity of hardenable adhesive material which will substantially exactly fill each cavity when the column member end portions are positioned therein; and placing into each cavity its respective determined quantity of hardenable adhesive material.

30. A method as claimed in claim 29 in which the quantity of hardenable adhesive material determined for a selected one of said cavities will substantially exactly fill said selected one when the ends portions of two column members are positioned therein and further comprising inserting an end portion of a further column member into said selected one of said cavities prior to allowing the adhesive to harden.

* * * * *